US005395633A

United States Patent [19]

Lee

[11] Patent Number: 5,395,633

[45] Date of Patent: Mar. 7, 1995

[54] METHOD FOR AUTOMATICALLY CONTROLLING COOKING OF FOOD WITH LOW MOISTURE CONTENT

[75] Inventor: Do Y. Lee, Kyungsangnam, Rep. of Korea

[73] Assignee: Goldstar Co., Ltd., Seoul, Rep. of Korea

[21] Appl. No.: 166,634

[22] Filed: Dec. 15, 1993

[51] Int. Cl.[6] ..... H05B 6/00

[52] U.S. Cl. ..... 426/233; 99/325; 426/243

[58] Field of Search ..... 426/233, 523, 243; 99/325, 341, 342

[56] References Cited

U.S. PATENT DOCUMENTS

| | | | |
|---|---|---|---|
| Re. 31,094 | 11/1982 | Kobayashi et al. | 99/325 |
| 4,281,022 | 7/1981 | Buck | 426/233 |
| 4,780,588 | 10/1988 | Edamura | 99/325 |

*Primary Examiner*—George Yeung
*Attorney, Agent, or Firm*—Finnegan, Henderson Farabow, Garrett & Dunner

[57] ABSTRACT

An automatic cooking control method capable of cooking a food with a low moisture content at an optimum by utilizing a variation in output voltage of a humidity sensor. When a key signal corresponding to a food with a low moisture content is received, an initialization is performed. Then, the maximum voltage indicative of the maximum humidity is determined by reading the continuously increasing output voltage from the humidity sensor 10 times for 10 seconds. After the determination of the maximum voltage, a determination is made whether the output voltage has reached a sensing voltage corresponding to a voltage obtained by deducing, from the maximum voltage, a minute voltage varied depending on the kind of the food. The cooking operation is completed when the output voltage from the humidity sensor has reached the sensing voltage.

5 Claims, 6 Drawing Sheets

METHOD FOR AUTOMATICALLY CONTROLLING COOKING OF FOOD WITH LOW MOISTURE CONTENT

BACKGROUND OF THE INVENTION

The present invention relates to a microwave oven, and more particularly to an automatic cooking control method capable of cooking a food with a low moisture content at an optimum by utilizing a variation in output voltage of a humidity sensor.

FIG. 1 is a block diagram of a typical microwave oven.

As shown in FIG. 1, the microwave oven includes a key input unit 1 for inputting given data, a sensor control unit 2 for sensing the moisture content of a food and transmitting it, and a central processing unit 3 for receiving output signals from the key input unit 1 and the sensor control unit 2 and controlling various units of the microwave oven in accordance with the received signals. The microwave oven further includes a high-frequency oscillating drive unit 4 for heating the food under a control of the central processing unit 3, a display unit 5 for displaying digital information on the current cooking conditions of digital, and a fan motor drive unit 6.

FIG. 2 is a flowchart illustrating a conventional automatic cooking control method applied to the microwave oven of FIG. 1.

As shown in FIG. 2, in accordance with this method an initialization is performed after application of power (step S2). Thereafter, a determination is made about whether a humidity sensor (not shown) has reached its self heat-emitting state (step S3). When the humidity sensor has reached its self heat-emitting state, a zero-balancing is carried out for making the humidity sensor meet an initial state of the microwave oven (step S6).

However, when the humidity sensor has not reached its self heat-emitting state yet, a determination is made about whether one minute has elapsed (step S4). Where one minute has lapsed, the operation is determined as an error (step S5). When one minute has not elapsed yet, the operation returns to the step S3.

After the zero-balancing performed at the step S6, a heating is initiated by a heater equipped in the humidity sensor (step S7). Then, the minimum voltage Vmin is determined by reading an output value from the humidity sensor every second (step S8).

Thereafter, a determination is made whether the output voltage from the humidity sensor has reached a sensing voltage Vs corresponding to the previously determined data value applied from the key input unit 1 (step S9). Where the output voltage has reached the sensing voltage Vs, as shown in FIG. 3, an additional heating time $KT_1$ is calculated by multiplying the time $T_1$taken until the output voltage reaches the sensing voltage Vs by an intrinsic constant K determined depending on the food (step S12). Additional heating is then performed for the calculated additional heating time $KT_1$ (step S13). At step S14, the cooking is completed.

When it is determined at the step S9 that the output voltage from the humidity sensor has not reached the sensing voltage Vs yet, a determination is made about whether the time $T_1$ taken in reaching the sensing voltage Vs has exceeded 20 minutes (step S10). If 20 minutes has elapsed, the cooking is completed but the operation is determined as an error (step S11). If not, the operation returns to the step S9.

At the step S9, the sensing voltage Vs is determined to be $V_{min}+\Delta V$. Vmin represents the minimum voltage determined at the step S8 and $\Delta V$ represents a minute voltage varied depending on the kind of the food and stored in a memory (not shown) equipped in the central processing unit 3. Therefore, the sensing voltage Vs is a voltage varied depending on the food.

As the sensing voltage Vs varies, the time $T_1$ is varied. Such a variation in time $T_1$ results in a variation in cooking time.

The intrinsic constant K is obtained from the memory of the central processing unit 3 which stores intrinsic constants of various foods.

As apparent from the above description, the conventional method used for automatically cooking a food with a high moisture content senses a vapor generated when the food is cooked, thereby sensing the kind of the food and determines the sensing voltage Vs appropriate for the sensed food kind. Then, this method performs a heating for the time $T_1$ taken in reaching the sensing voltage Vs and then an additional heating for the time $KT_1$ determined by multiplying the time $T_1$ by the intrinsic constant K determined depending on the kind of the food.

In this method, there is no problem in cooking a food with a high moisture content, because the cooking is performed in accordance with a data value determined from the sensed moisture. In case of a food, such as bacon or popcorn, having a low moisture content to be cooked in a short time, a slight variation in cooking time results in a difficulty to achieve the optimum cooking, because the time $T_1$ taken in reaching the sensing voltage Vs is varied. For instance, where popcorn is cooked in accordance with the conventional automatic cooking control method, the popcorn may be half-done or burned.

SUMMARY OF THE INVENTION

Therefore, an object of the invention is to solve the above-mentioned problems encountered in the prior art and to provide a method for automatically controlling cooking of a food with a low moisture content, capable of achieving the cooking at an optimum for foods with a low moisture content by determining whether an output voltage from a humidity sensor has been increased, sensing a point where the output voltage is decreased from the maximum voltage by a predetermined value, and completing the cooking operation at the sensed point.

In accordance with the present invention, this object can be accomplished by providing a method for automatically controlling cooking of a food with a low moisture content, comprising the steps of: determining whether a key signal corresponding to a food with a low moisture content has been inputted; determining the minimum voltage; reading an output voltage from a humidity sensor n times for a predetermined period after completion of the minimum voltage determination and thereby determining the maximum voltage; determining whether the output voltage from the humidity sensor has reached a sensing voltage after completion of the maximum voltage determination; and completing the cooking operation when the output voltage from the humidity sensor has reached the sensing voltage.

BRIEF DESCRIPTION OF THE DRAWINGS

Other objects and aspects of the invention will become apparent from the following description of embodiments with reference to the accompanying drawings.

DETAILED DESCRIPTION OF THE PREFERRED EMBODIMENT

Figure 1:
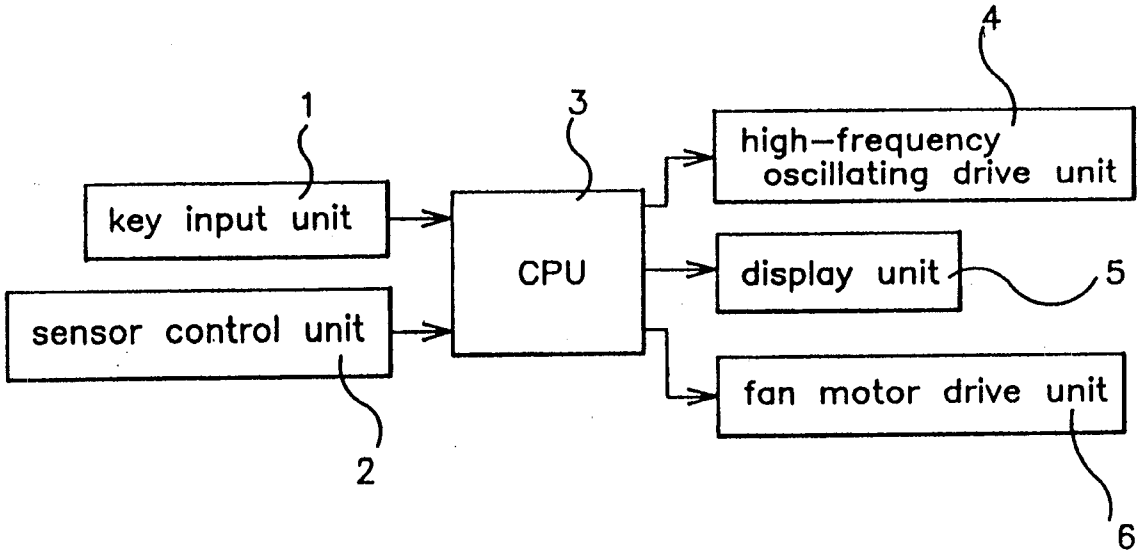
FIG. 1 is a block diagram of a typical microwave oven.
Figure 4:
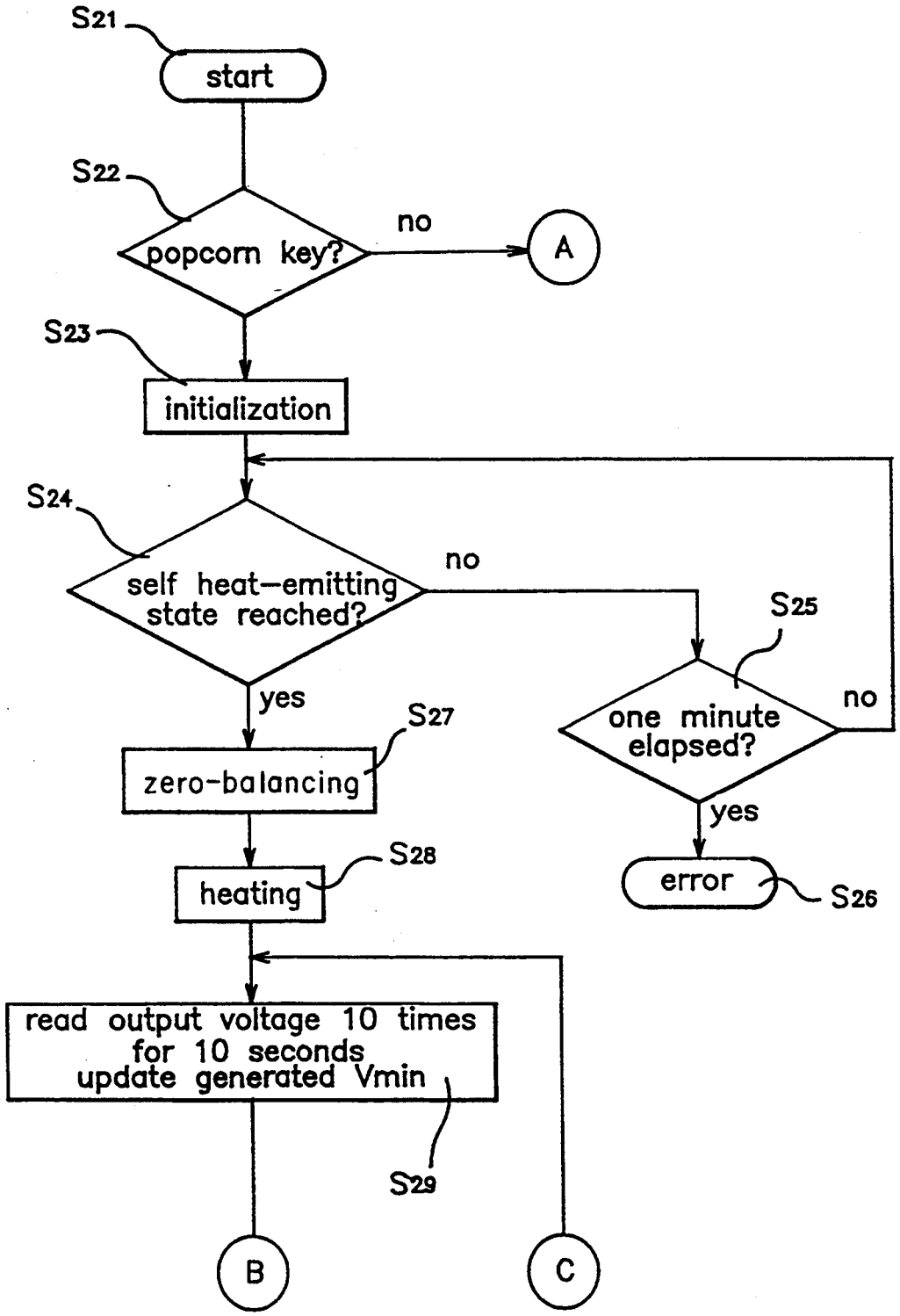
FIG. 4 is a flowchart illustrating an automatic cooking control method applicable to the microwave oven of FIG. 1 in accordance with the present invention.
Figure 4:
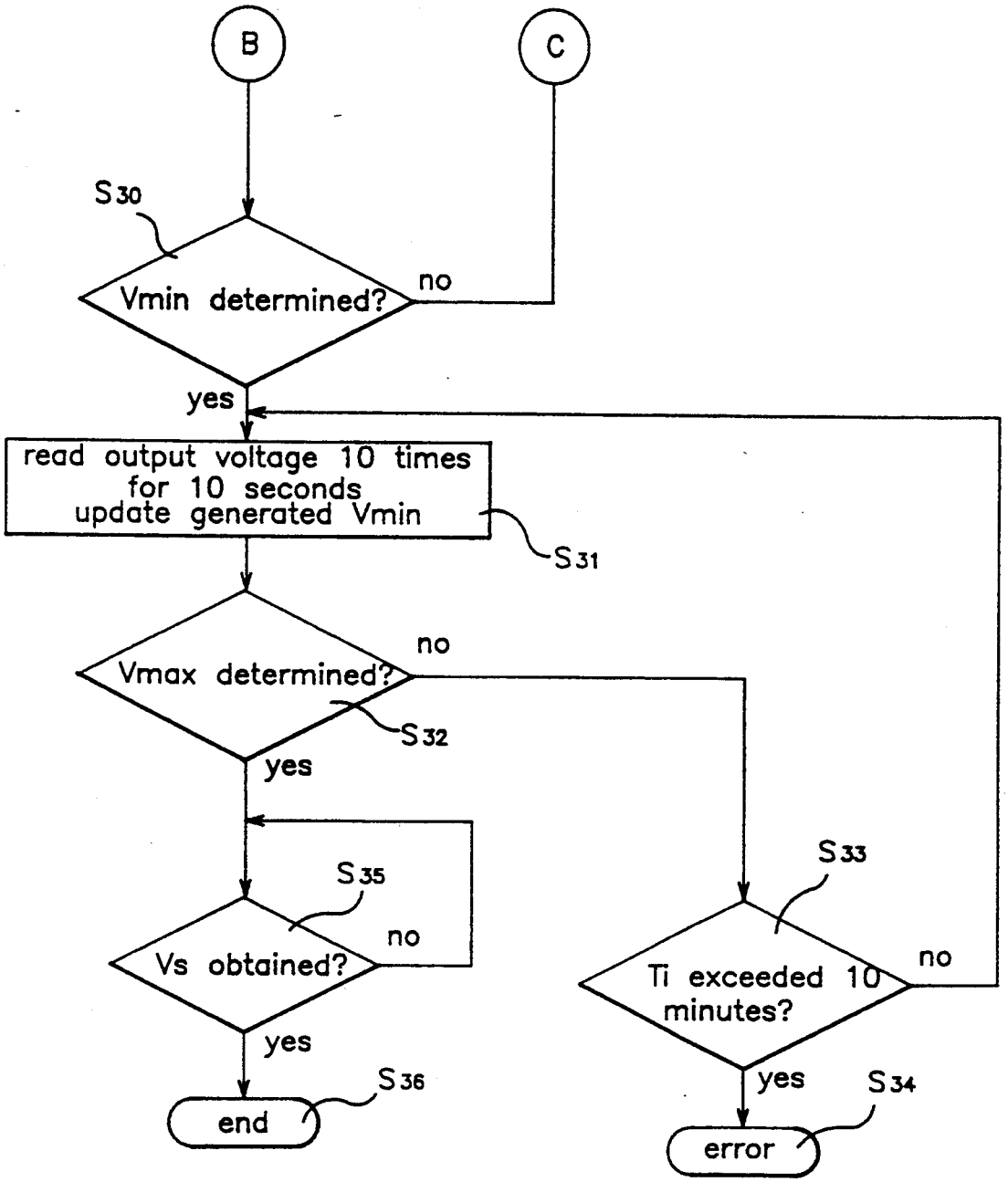

FIG. 4 is a flowchart illustrating an automatic cooking control method applicable to the microwave oven of FIG. 1 in accordance with the present invention.

Figure 2:
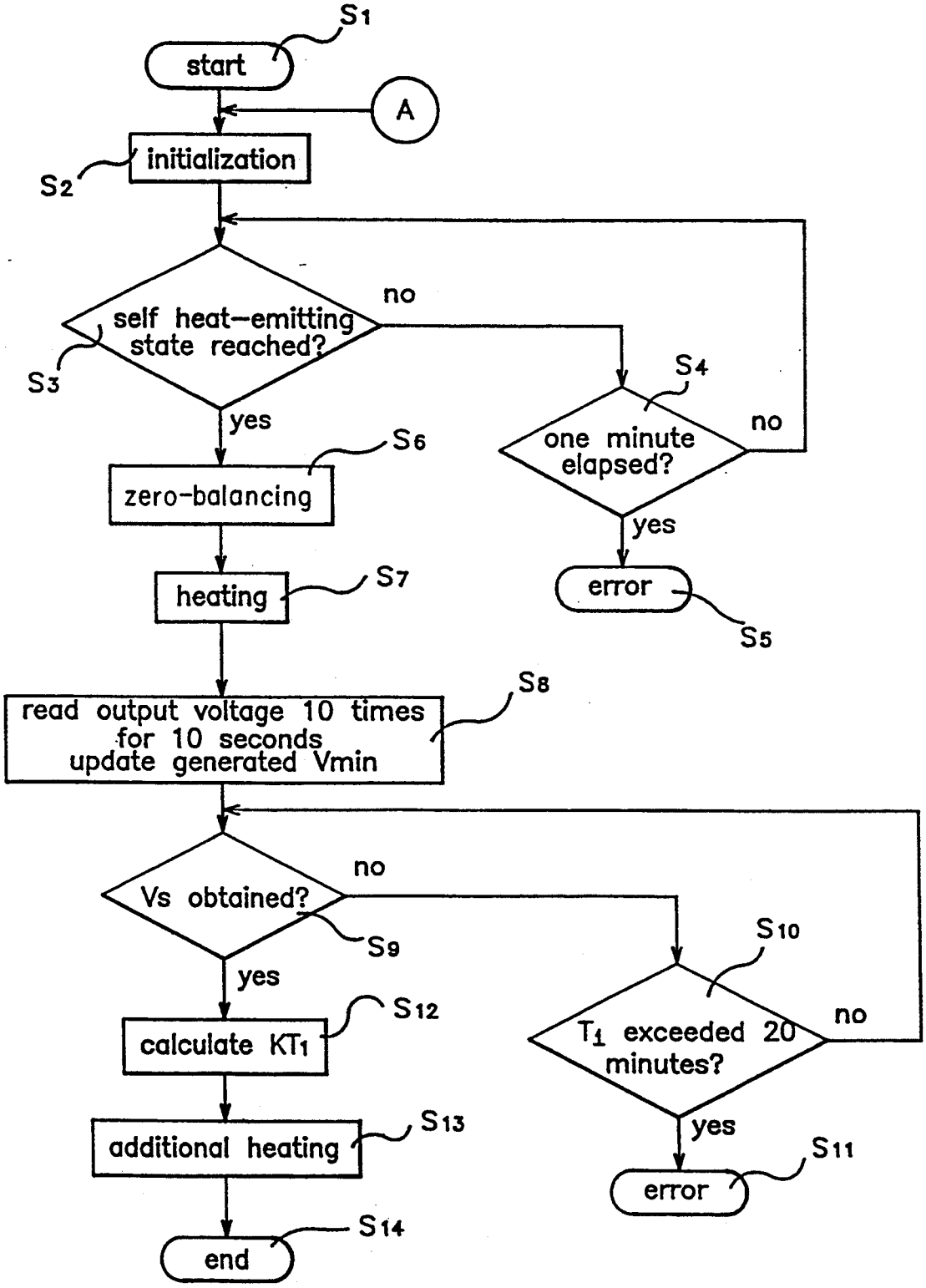
FIG. 2 is a flowchart illustrating a conventional automatic cooking control method applied to the microwave oven of FIG. 1.
Figure 3:
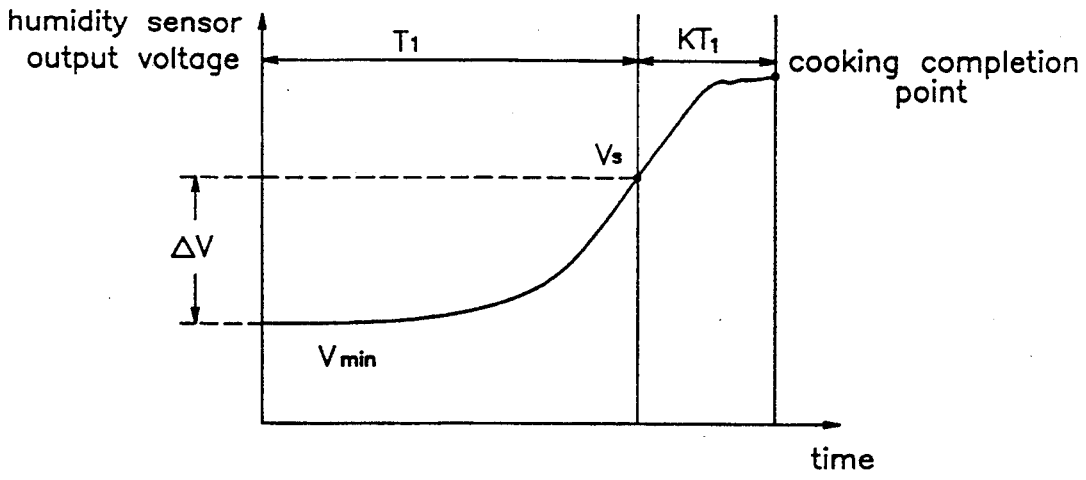
FIG. 3 is a graph illustrating a variation in output voltage of a humidity sensor depending on the lapse of time in accordance with the prior art.

When a user manipulates a selected key of the key input unit 1 (FIG. 1) of the microwave oven under a condition that a power has been applied, the high-frequency oscillating drive unit 4 and the fan motor drive unit 6 are driven under control of the central processing unit 3 so as to initiate the cooking operation in accordance with the method of the present invention, as shown in FIG. 4 (step S21). Thereafter, a determination is made about whether a key signal for cooking a food with a low moisture content, such as a popcorn key has been received from the key input unit 1 (step S22). Where a key signal other than the popcorn cooking key signal has been received, the operation proceeds to a routine A for executing the conventional cooking procedure shown in FIG. 2.

When the popcorn cooking key signal has been received, an initialization is performed (step S23). Thereafter, a determination is made about whether the humidity sensor has reached its self heat-emitting state (step S24). When the humidity sensor has reached its self heat-emitting state, a zero-balancing is carried out for making the humidity sensor meet an initial state of the microwave oven (step S27).

However, when the humidity sensor has not reached its self heat-emitting state yet, a determination is made about whether one minute has elapsed (step S25). Where one minute has lapsed, the operation is determined as an error (step S26). When one minute has not elapsed yet, the operation returns to the step S24.

After the zero-balancing performed at the step S27, heating is initiated by a heater equipped in the humidity sensor (step S28). At this time, the heating time is counted. Then, the minimum voltage Vmin is determined by reading an output voltage from the humidity sensor 10 times for 10 seconds (steps S29 and S30).

When the output voltage from the humidity sensor is decreased, it is updated to be determined as the minimum voltage Vmin.

Subsequently, the maximum voltage Vmax is determined by reading the continuously increasing output voltage from the humidity sensor 10 times for 10 seconds (step S31). The maximum voltage Vmax is a voltage generated at the highest humidity.

Figure 5:
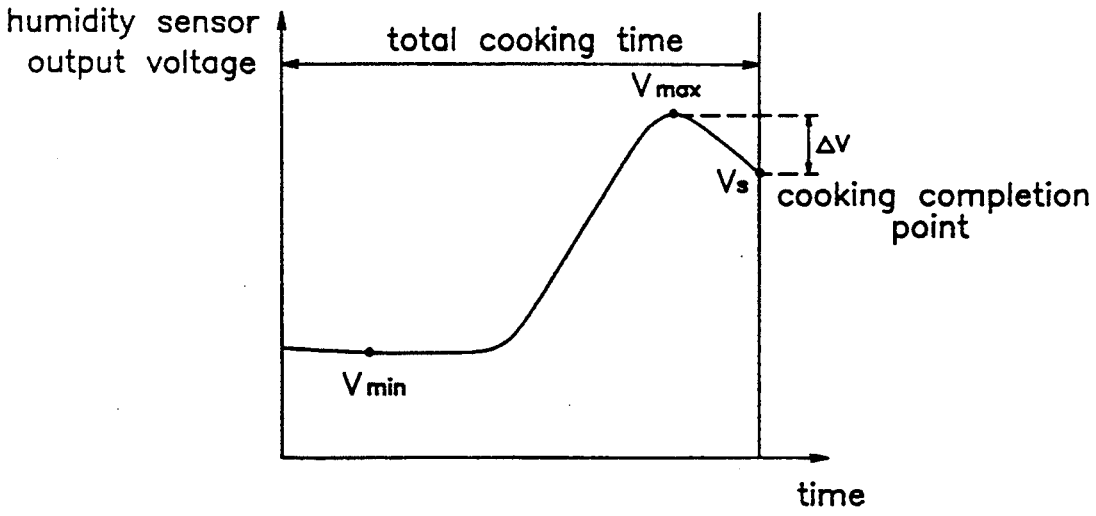
FIG. 5 is a graph illustrating a variation in output voltage of a humidity sensor depending on the lapse of time in accordance with the present invention.

When the output voltage from the humidity sensor is decreased after the determination of the maximum voltage Vmax, as shown in FIG. 5, a determination is made whether the output voltage has reached a sensing voltage Vs corresponding to the previously determined data value (step S35). Where the output voltage has reached the sensing voltage Vs, the cooking operation is completed. If the output voltage has not reached the sensing voltage Vs yet, the operation returns to the step S35 so as to continuously determine whether the output voltage has reached the sensing voltage Vs.

At the step S35, the sensing voltage Vs is determined to be $Vmax-\Delta V$. Here, Vmax represents the maximum voltage determined at the step S32 and $\Delta V$ represents a minute voltage varied depending on the kind of the food and stored in a memory (not shown) equipped in the central processing unit 3.

When the maximum voltage Vmax has not been determined at the step S32, a determination is made about whether 10 minutes has elapsed (step S33). If 10 minutes has elapsed, the operation is determined as an error (step S34). If not, the operation returns to the step S31.

In cooking a food having a low moisture content, a phenomenon occurs that the output voltage of the humidity sensor is decreased from the point of time when the cooking is completed. Since such a phenomenon has a constant pattern irrespective of the food amount and the food kind, the method of the present invention achieves the optimum cooking by sensing the cooking completion point to complete the cooking operation.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A method for automatically controlling a cooking operation for cooking a food with a low moisture content in a microwave oven, the method comprising the steps of:

receiving a key signal for cooking the food;

determining a minimum voltage;

reading an output voltage from a humidity sensor a plurality of times during a predetermined period after completion of the minimum voltage determination and thereby determining a maximum voltage;

determining whether the output voltage from the humidity sensor has reached a sensing voltage after completion of the maximum voltage determination; and completing the cooking operation when the output voltage from the humidity sensor has reached the sensing voltage.

2. A method in accordance with claim 1, wherein the maximum voltage is a voltage indicative of a maximum humidity in the microwave oven.

3. A method in accordance with claim 1, wherein the sensing voltage is a voltage obtained by deducing a minute voltage from the maximum voltage.

4. A method in accordance with claim 3, wherein the minute voltage is a voltage varied depending on the kind of the food.

5. A method for automatically controlling a cooking operation for cooking a food with a low moisture content in a microwave oven, the method comprising the steps of:

receiving a key signal for cooking the food;

determining whether an output voltage from a humidity sensor in the microwave oven has increased;

sensing a point where the output voltage has decreased by a predetermined value from a maximum voltage; and completing the cooking operation at the sensed point or a point where the output voltage has decreased by a constant value from the sensed point.

* * * * *